US005897420A

United States Patent [19]

Lawrence et al.

[11] Patent Number: 5,897,420

[45] Date of Patent: Apr. 27, 1999

[54] ANIMAL DOLL WITH DETACHABLE PARTS

[76] Inventors: Jeri Lawrence; Lowell Lawrence, both of 7450 SVL, Victorville, Calif. 92392

[21] Appl. No.: 08/940,502

[22] Filed: Sep. 30, 1997

[51] Int. Cl.[6] ..... A63H 3/12; A63H 3/16; A63H 3/02

[52] U.S. Cl. ..... 446/321; 446/100; 446/369

[58] Field of Search ..... 446/321, 901, 446/100, 99, 369; 273/DIG. 30

[56] References Cited

U.S. PATENT DOCUMENTS

| | | | |
|---|---|---|---|
| Re. 19,238 | 7/1934 | Burke | 446/901 X |
| 858,090 | 6/1907 | Meinecke | 446/99 |
| 1,211,590 | 1/1917 | Kennedy | 446/99 |
| 1,239,982 | 9/1917 | Sweet | 446/100 |
| 1,322,713 | 11/1919 | Marshall | 446/100 |
| 1,731,926 | 10/1929 | Hitchcock | 446/100 |
| 5,378,184 | 1/1995 | Bro et al. | 446/99 |

FOREIGN PATENT DOCUMENTS

| | | | |
|---|---|---|---|
| 566160 | 11/1973 | Switzerland | 446/100 |
| 2 013 508 | 8/1975 | United Kingdom | 446/901 |

*Primary Examiner*—D. Neal Muir

[57] ABSTRACT

A new animal doll with detachable parts for providing a animal toy that can be constructed to form different types of animals or creatures of original creation. The inventive device includes a torso member with detachable cat, pig and bunny head members, a pair of detachable elongate arm members, a pair of detachable elongate leg members, a detachable first tail member, and a detachable elongate second tail member.

1 Claim, 2 Drawing Sheets

ANIMAL DOLL WITH DETACHABLE PARTS

BACKGROUND OF THE INVENTION

1. Field of the Invention

The present invention relates to dolls and more particularly pertains to a new animal doll with detachable parts for providing a animal toy that can be constructed to form different types of animals or creatures of original creation.

2. Description of the Prior Art

The use of dolls is known in the prior art. More specifically, dolls heretofore devised and utilized arc known to consist basically of familiar, expected and obvious structural configurations, notwithstanding the myriad of designs encompassed by the crowded prior art which have been developed for the fulfillment of countless objectives and requirements.

Known prior art dolls include U.S. Pat. No. 4,579,537; U.S. Pat. No. 4,208,832; U.S. Pat. No. 5,232,369; U.S. Pat. No. 5,195,917; U.S. Pat. No. 4,504,240; and U.S. Pat. No. Des. 307,613.

While these devices fulfill their respective, particular objectives and requirements, the aforementioned patents do not disclose a new animal doll with detachable parts. The inventive device includes a torso member with detachable cat, pig and bunny head members, a pair of detachable elongate arm members, a pair of detachable elongate leg members, a detachable first tail member, and a detachable elongate second tail member.

In these respects, the animal doll with detachable parts according to the present invention substantially departs from the conventional concepts and designs of the prior art, and in so doing provides an apparatus primarily developed for the purpose of providing a animal toy that can be constructed to form different types of animals or creatures of original creation.

SUMMARY OF THE INVENTION

In view of the foregoing disadvantages inherent in the known types of dolls now present in the prior art, the present invention provides a new animal doll with detachable parts construction wherein the same can be utilized for providing a animal toy that can be constructed to form different types of animals or creatures of original creation.

The general purpose of the present invention, which will be described subsequently in greater detail, is to provide a new animal doll with detachable parts apparatus and method which has many of the advantages of the dolls mentioned heretofore and many novel features that result in a new animal doll with detachable parts which is not anticipated, rendered obvious, suggested, or even implied by any of the prior art dolls, either alone or in any combination thereof.

To attain this, the present invention generally comprises a torso member with detachable cat, pig and bunny head members, a pair of detachable elongate arm members, a pair of detachable elongate leg members, a detachable first tail member, and a detachable elongate second tail member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new animal doll with detachable parts apparatus and method which has many of the advantages of the dolls mentioned heretofore and many novel features that result in a new animal doll with detachable parts which is not anticipated, rendered obvious, suggested, or even implied by any of the prior art dolls, either alone or in any combination thereof.

It is another object of the present invention to provide a new animal doll with detachable parts which may be easily and efficiently manufactured and marketed.

It is a further object of the present invention to provide a new animal doll with detachable parts which is of a durable and reliable construction.

An even further object of the present invention is to provide a new animal doll with detachable parts which is susceptible of a low cost of manufacture with regard to both materials and labor, and which accordingly is then susceptible of low prices of sale to the consuming public, thereby making such animal doll with detachable parts economically available to the buying public.

Still yet another object of the present invention is to provide a new animal doll with detachable parts which provides in the apparatuses and methods of the prior art some of the advantages thereof, while simultaneously overcoming some of the disadvantages normally associated therewith.

Still another object of the present invention is to provide a new animal doll with detachable parts for providing a animal toy that can be constructed to form different types of animals or creatures of original creation.

Yet another object of the present invention is to provide a new animal doll with detachable parts which includes a torso member with detachable cat, pig and bunny head members, a pair of detachable elongate arm members, a pair of detachable elongate leg members, a detachable first tail member, and a detachable elongate second tail member.

Still yet another object of the present invention is to provide a new animal doll with detachable parts that helps a child with a non-frustrating way of learning about animals and body parts.

Even still another object of the present invention is to provide a new animal doll with detachable parts that can be made into unusual and funny creatures over and over again.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
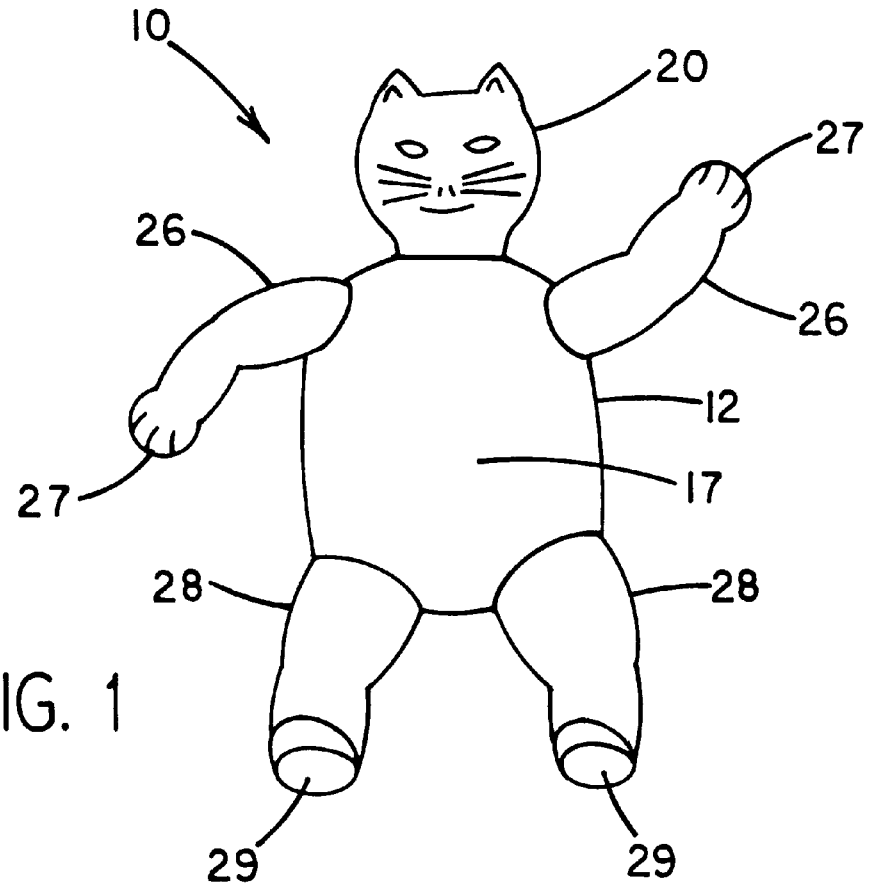
FIG. 1 is a front side view of an assembled animal doll with detachable parts according to the present invention.

With reference now to the drawings, and in particular to FIGS. 1 through 4 thereof, a new animal doll with detachable parts embodying the principles and concepts of the present invention and generally designated by the reference numeral 10 will be described.

As best illustrated in FIGS. 1 through 4, the animal doll with detachable parts 10 generally comprises a torso member 12 with detachable cat, pig and bunny head members 20,22,24, a pair of detachable elongate arm members 26, a pair of detachable elongate leg members 28, a detachable first tail member 30, and a detachable elongate second tail member 32.

The head members 20,22,24 are each shaped and ornamented to resemble their respective animal. That is, the cat head member 20 is shaped and ornamented to resemble the head a cat, the pig head member 22 is shaped and ornamented to resemble the head of a pig, and the bunny head member 24 is shaped and ornamented to resemble the head of a bunny. Preferably, each of the arm members 26 is designed to have a hand or paw 27 shaped at one end. Similarly, each of the leg members 28 is designed to have a foot or paw 29 shaped at one end as well. In the preferred embodiment of this invention 10, the first tail member 30 is shaped to resemble the cotton tail of a bunny while the second tail member 32 is elongated to resemble a cat or pig tail.

Ideally, the torso member 12, the head members 20,22,24, the leg members 28, the arm members 26, and the second tail member 32 are constructed having an outer fuzzy material layer 38, such as some sort felt, surrounding an inner padding material, such as cotton or a foamed material.

Preferably, provided on the outer surface of the torso member 12 are a plurality of spaced apart first attachment components 34. Correspondingly, each of the head members 20,22,24 and each of the attachment ends of the arm, leg and tail members 26,28,30,32 have a second attachment component 36 provided on them that are each detachably attachable to a first attachment component 34 on the torso member 12. Ideally, the first attachment components 34 are each one portion of a hook and loop fastener and the second attachment components 36 are each the other complementary portion of a hook and look fastener that is attachable to the hook and loop portion of the first attachment components 34.

Figure 2:
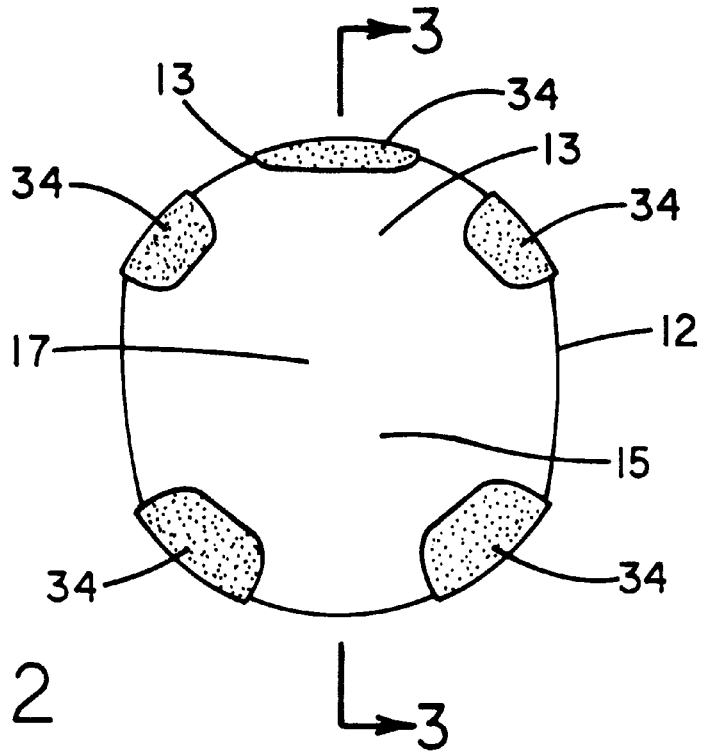
FIG. 2 is a front side view of the torso member of the present invention.
Figure 3:
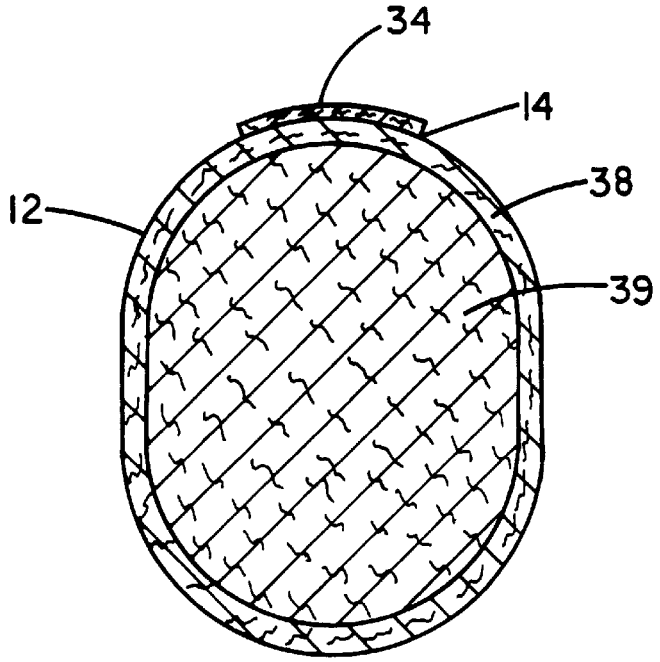
FIG. 3 is a schematic cross sectional view taken from line 3—3 on FIG. 2 of the torso member of the present invention illustrating the outer fuzzy material layer and the inner padding material.
Figure 4:
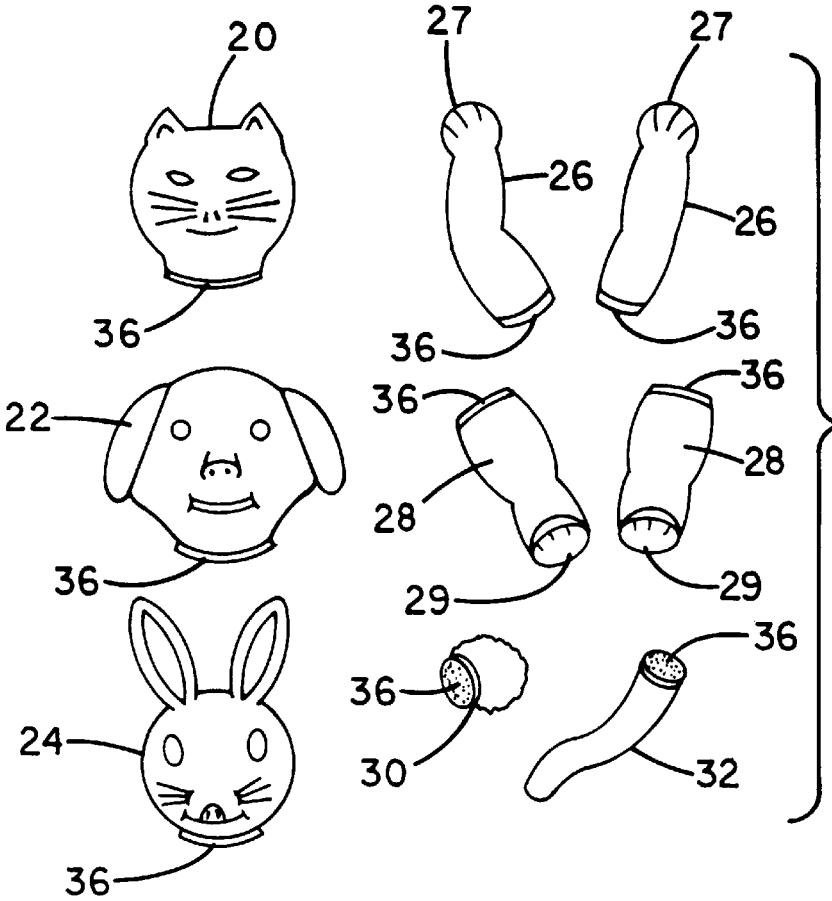
FIG. 4 is a schematic side view of the detachable head members and limb members of the present invention.

Preferably, as shown in FIG. 2, the torso member 12 is oblong and cylindrical in shape. In this embodiment of the invention, the torso member 12 has an first attachment component 36 located on its upper region 13 towards the top 14 of the torso member. The torso member 12 also has another first attachment component (not shown) located on its lower region 15 the towards the back of the torso member. Towards the front 17 of the torso member 12 are a first pair of first attachment components 34 located on the upper region 13 and a second pair of first attachment components 34 located on the lower region 15.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A doll, comprising:

an oblong cylindrical torso member;

a cat head member being shaped and ornamented to resemble the head of a cat;

a pig head member being shaped and ornamented to resemble the head of a pig;

a bunny head member being shaped and ornamented to resemble the head of a bunny;

a pair of elongate arm members each having an attachment end and a hand end;

a pair of elongate leg members each having an attachment end and a foot end;

a first tail member having an attachment end and being shaped to resemble a tail of a cottontail bunny;

an elongate second tail member having an attachment end; and said torso member having a top, a bottom, a front surface, a back surface, an upper region adjacent said top, a lower region adjacent said bottom, an outer perimeter extending therearound between said front and back surfaces and having a cross-section which defines a semicircular top edge a semicircular bottom edge, and a pair of linear side edges, and a plurality of spaced apart first attachment components being provided on said outer perimeter of said torso member for mounting said head, arm, leg, and tail members such that said head, arm, and leg members radiate from said torso member in substantially the same plane, wherein the first attachment components are positioned at a center of the top edge and at opposite ends of the top edge and the bottom edge of the outer perimeter of the torso member, a first said first attachment component being located at said upper region towards said top of said torso member, a second said first attachment component being located at said lower region of said torso member, a third and fourth said first attachment components being located at said upper region of said torso member, a fifth and sixth said first attachment components being located at said lower region of said torso member;

wherein a torso length is defined between said top and said bottom of said torso member, said fifth and sixth said first attachment components being located at said lower region of said torso member at a distance of less than one-fourth the torso length from the bottom of said torso member;

a plurality of second attachment components, each said second attachment portion being detachably attachable to a said first attachment component, a said second attachment component being provided on said cat head member, said pig head member, said bunny head member, said attachment end of each of said arm members, said attachment end of each of said leg members, said attachment end of said first tail member, and said attachment end of said second tail member, said second attachment portions being for permitting attachment of said head, arm, leg, and tail members to said torso member, wherein said first attachment components are each one portion of a hook and loop fastener and said second attachment components are each the other complementary portion of a hook and loop fastener; and wherein said torso member, said cat head member, said pig head member, said bunny head member, said leg members, said arm members, and said second tail member are constructed having an outer fuzzy material layer surrounding an inner padding material.

* * * * *